US007770671B2

(12) United States Patent
Patel

(10) Patent No.: US 7,770,671 B2
(45) Date of Patent: Aug. 10, 2010

(54) NOZZLE HAVING A SPRAY PATTERN FOR USE WITH AN EARTH BORING DRILL BIT

(75) Inventor: Suresh G. Patel, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/245,632

(22) Filed: Oct. 3, 2008

(65) Prior Publication Data

US 2009/0090561 A1 Apr. 9, 2009

Related U.S. Application Data

(60) Provisional application No. 60/977,269, filed on Oct. 3, 2007.

(51) Int. Cl.
*E21B 10/18* (2006.01)

(52) U.S. Cl. ..... 175/340; 175/393

(58) Field of Classification Search ..... 175/340, 175/393, 424
See application file for complete search history.

(56) References Cited

U.S. PATENT DOCUMENTS

| | | | | |
|---|---|---|---|---|
| 1,060,929 | A * | 5/1913 | Monberg | 175/107 |
| 2,264,440 | A | 12/1941 | Havlick | |
| 3,727,704 | A | 4/1973 | Abplanalp | |
| 3,823,789 | A | 7/1974 | Garner | |
| 4,303,136 | A | 12/1981 | Ball | |
| 4,378,853 | A | 4/1983 | Chia et al. | |
| 4,391,339 | A | 7/1983 | Johnson, Jr. et al. | |
| 4,400,024 | A | 8/1983 | Ratcliff et al. | |
| 4,527,642 | A | 7/1985 | Knowlton et al. | |
| 4,606,418 | A | 8/1986 | Thompson | |
| 4,658,918 | A | 4/1987 | Matson | |
| 4,723,612 | A | 2/1988 | Hicks | |
| 4,776,411 | A | 10/1988 | Jones | |
| 4,887,677 | A | 12/1989 | Warren et al. | |
| 4,981,184 | A | 1/1991 | Knowlton et al. | |
| 5,316,095 | A | 5/1994 | Tibbitts | |
| 5,380,068 | A | 1/1995 | Raghavan | |
| 5,992,763 | A | 11/1999 | Smith et al. | |
| 6,142,247 | A | 11/2000 | Pessier | |
| 6,311,793 | B1 | 11/2001 | Larsen et al. | |
| 6,354,387 | B1 | 3/2002 | Harris et al. | |
| 2006/0266557 | A1 * | 11/2006 | Estes | 175/340 |
| 2007/0163811 | A1 * | 7/2007 | Gutmark et al. | 175/340 |
| 2008/0121434 | A1 * | 5/2008 | Wells et al. | 175/340 |
| 2009/0020334 | A1 * | 1/2009 | Gavia | 175/57 |

OTHER PUBLICATIONS

International Search Report and Written Opinion dated Apr. 9, 2009, 9 pages.

* cited by examiner

*Primary Examiner*—William P Neuder
(74) *Attorney, Agent, or Firm*—Bracewell & Giuliani LLP

(57) ABSTRACT

An earth boring drill bit having a cleaning nozzle for cleaning cutting elements on the face of the drill bit. A notch is included on the nozzle face for directing an elongated and coherent fluid flow from the nozzle outlet to the cutting element face. The nozzle face may include more than one notch for cleaning elements disposed in locations around the nozzle. The nozzle may be at the ends of a row of cutting elements, or disposed in the middle of a row of cutting elements.

16 Claims, 2 Drawing Sheets

NOZZLE HAVING A SPRAY PATTERN FOR USE WITH AN EARTH BORING DRILL BIT

RELATED APPLICATIONS

This application claims priority to and the benefit of co-pending U.S. Provisional Application Ser. No. 60/977,269, filed Oct. 3, 2007, the full disclosure of which is hereby incorporated by reference herein in its entirety.

BACKGROUND

1. Field of Invention

The disclosure herein relates to nozzles for use with earth boring bits. More specifically, the present disclosure concerns nozzles configured with a notch to create a spray pattern for cleaning earth boring bits.

2. Description of Prior Art

Drilling systems having earth boring drill bits are typically used in the oil and gas industry for creating wells drilled into hydrocarbon bearing substrata. Drilling systems typically comprise a drilling rig (not shown) used in conjunction with a rotating drill string wherein the drill bit is disposed on the terminal end of the drill string and used for boring through the subterranean formation. Drill bits typically are chosen from one of two types, either drag bits or roller cone bits. Drag bits typically have no moving parts on the base and shear the formation by the cutting elements on its surface. These cutting elements may comprise an outer surface of polycrystalline diamond compact (PDC) bits and some have diamond impregnated bits on their surface. Roller cone bits or rotary cone bits typically have one or more conic roller cones with cutting teeth on the outer surface of the cone. Rotating the bit body with the cutting elements on the outer surface of the roller cone body crushes the rock and the cuttings may be washed away with drilling fluid.

Drilling fluid may be introduced into the cutting process by a nozzle disposed on the cutting phase of either a drag bit or a rolling cone bit. These spray patterns typically are conically shaped and directed against the cutting elements. The high pressure of the spray impinging on the cutting elements cleans the surface of the cutting element by removing debris which enhances drilling. The high pressure fluid also captures detrius and other bits of downhole debris carries it up through the bore hole as it flows to the surface. One problem with the conical spray pattern is it impinges on other components within the particular drilling bit, which due to the erosive nature of the fluid, i.e. can prematurely wear away other portions of the drilling bit.

In the case of the PDC bits, cutting is performed by shearing away the subterranean formation thereby producing shavings that are larger than those of a conventional diamond bit. Accordingly, typically nozzle tips for the drilling mud are disposed proximate to the formation surface than wherein the fluid flow of the drilling fluid not only serves to transport the cuttings away from the cutting surface but also helps erode pieces of the rock and structure beneath the drill bit. Thus, efficiently removing the cuttings serves to prevent recutting of rock fragments thereby reducing the stress on the drill bit. The number of nozzles on each of these different types of bits depends on the bit size and the arrangement of the cutting elements on the face of the individual drill bit. Accordingly, the total flow area of the nozzles is determined by first evaluating the requirements of hydraulics for the particular drilling situation. Thus, the nozzle flow area depends on these hydraulic requirements, should the nozzle cross sectional area be of a sufficiently small value, the chances of plugging in the nozzle are increased. Moreover, the life of a drill bit having a PDC cutter face is typically extended when it is adequately lubricated and cooled during the drilling process by the drilling fluid. In contrast, having inadequate fluid flow to the face of a PDC cutter allows formation cuttings to collect on the faces of the cutting elements. This collection of cuttings isolates the cutting elements from the drilling fluid. This also reduces the rate of penetration of the drilling bit and if the debris collection is sufficiently high the cutting elements may overheat which increases the wear rate.

SUMMARY OF INVENTION

Disclosed herein is an earth boring drill bit having a cutting surface with a cutting element disposed on the cutting face. A nozzle is included comprising an annular body having an outer surface and a passage extending through the length of the body. A face is included on the terminal end of the body. Formed on the face is a channel that extends from the body outer surface to the passage. When fluid flows from the nozzle, the channel enables a shaped cleaning and cooling stream (such as drilling fluid) to be discharged from the nozzle optionally directed laterally to the cutting element.

The nozzle may further comprise a second channel formed on the face extending from the body outer surface to the passage. The channel shape may be a "V" shape, a "U" shape, a half elliptical shape, or a semi-circular shape. Optionally, additional cutting elements may be included that form a row, wherein the nozzle is configured to direct fluid flow to the row of cutting elements. The drill bit may be a drag bit or roller cone bit. A drilling system may be coupled to the drill bit, where the drilling system includes a drill string, a rig for turning the string, and a means for delivering pressurized fluid to the drill bit. In other embodiments, the nozzle may be disposed at an end of a row or in the middle of a row. The nozzle size is easily determined for a nozzle having a circular inner channel.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be through and complete, and will fully convey the scope of the invention to those skilled in the art. Like numbers refer to like elements throughout.

The present disclosure includes embodiments of earth boring drill bits having a nozzle for directing fluid flow from the nozzle to a cutting element disposed on the drill bit. More specifically, in one embodiment, a nozzle will include a notched face such that the flow exiting the nozzle will travel through the notch in a direction transverse to the plane defining the nozzle exit and towards a cutting element of an earth boring drill bit. The earth boring drill bits considered for use with a nozzle described herein include PDC drill bits, diamond impregnated drill bits, roller cone drill bits, expandable reamers with drill bits, and other down hole tools utilizing nozzles. Optionally, the nozzle face may include more than one notch along its surface thereby creating multiple streams exiting the nozzle that may be directed in different directions towards cutting elements.

Figure 1:
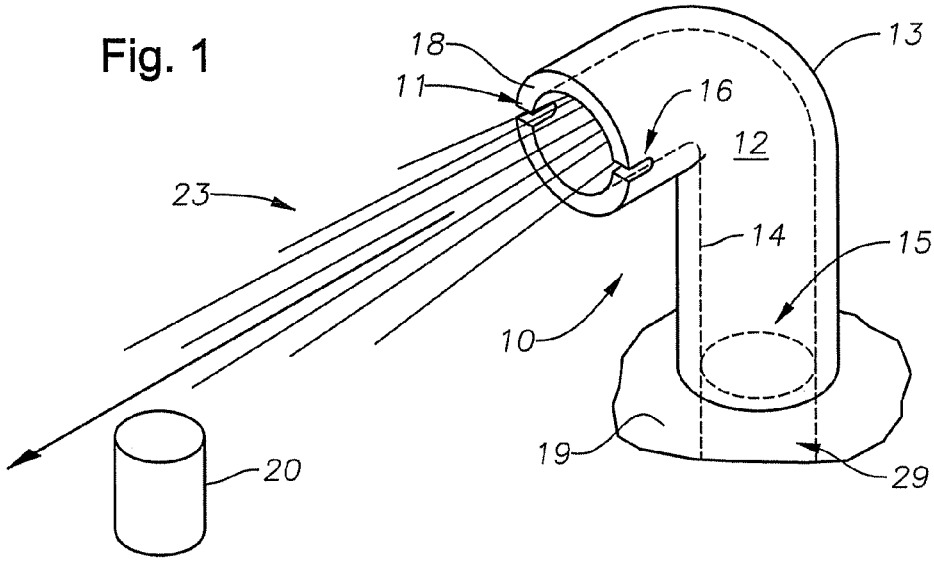
FIG. 1 illustrates in a side perspective view examples of a nozzle in accordance with this disclosure.

With reference now to FIG. 1, one embodiment of a nozzle 10 is shown in a side perspective view. The nozzle 10 is affixed to a drill bit cutting surface 19 and depicted having a fluid flow stream 23 directed at a bit cutting element 20, wherein the fluid stream 23 can cool and clean the bit cutting element 20. In this embodiment, the nozzle 10 comprises an annular body 12 having an outer surface 13 and a passage 14 formed along the length of the nozzle 10. The passage 14, or bore, registers with a feed line 29 that provides high pressure fluid to the passage 14 and thus the nozzle 10. The feed line 29 can connect to a bit body cavity that receives drilling fluid via a drill string. The junction between the passage and the feed line 29 defines a nozzle inlet 15. The nozzle 10 may be brazed into place on the bit cutting surface 19 over the feed line 29 exit, or created with the bit body such as in a mold.

The nozzle body 12 of FIG. 1 includes a substantially 90° elbow, however the body 12 is not limited to this configuration but instead the body can be straight with no elbow, have multiple elbows, or elbows at other than 90°. Other embodiments exist where the outer surface and passage are non-circular or substantially non-circular; a non-exclusive list of examples includes ovals, multisided areas such as squares, rectangles, polygons etc, those with undulating outer perimeters, to name a few. While the nozzle passage 14 is shown substantially coaxially around the nozzle axis, the passage 14 may be asymmetric within the nozzle 10.

A face 18 is illustrated at the nozzle outlet 11. The face 18 as illustrated is a largely planar surface perpendicular to the nozzle axis at the passage 14 exit and faces the cutting surface of the cutting element 20. However, the face can have other configurations such as sloped, angled, rounded or concave. A channel 16 is shown provided through the body 12 sidewall from the passage 14 or bore to the body outer surface 13 at the face 18. A portion of channel 16 is thus located on opposite sides of passage 14. In this embodiment, the channel 16, also referred to herein as a notch or cavity, extends from the outer surface 13 to the passage 14 along the face 18. As will be discussed in further detail below, the channel 16 alters the pattern of fluid exiting the nozzle 10 to shape a fluid spray. In the embodiment of FIG. 1, the channel 16 is shown having a curved "U" shaped contour. In this embodiment the bottom of the channel 16 is a selected depth in the nozzle body 12 from face 18, and channel 16 opposing sides are separated a width along the nozzle face 18.

Figure 1A:
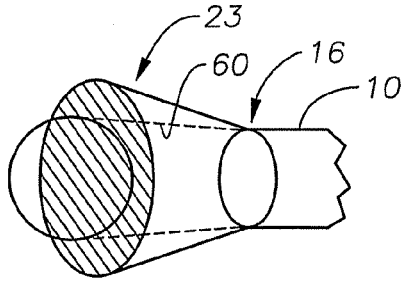
FIG. 1*a* depicts a comparison of a conical flow and a shaped flow from a notched nozzle.

Providing a discontinuous surface, such as a channel 16, within a nozzle passage 14 or bore, then flowing fluid through the passage 14, perturbs the flow and affects the flow stream 23 shape exiting the nozzle 10. As shown in FIG. 1*a*, the shape resulting from the added channel 16 is an elliptical stream 23 rather than a conical stream 60. The elliptical stream 23 is asymmetric about its axis having one cross sectional length greater than the other, the greater length is produced by the channels 16. In the embodiment of FIG. 1*a* the shaped flow path 23 from the notched nozzle 10 has a width greater than the conical stream 60 due to the channel 16 placement. Thus a stream from a nozzle can be shaped as desired by adding one or more channels 16 at selected locations on a nozzle face 18. The shaping can be important to maximize cutting element 20 contact while avoiding eroding contact on other portions of a bit. To enhance shaping, a notch or channel 16 may be angled with respect to the axis of the nozzle exit 11. With reference back to FIG. 1, the angle between the channel 16 and the axis of the nozzle exit 11 is about 90°. However the angle between the channel 16 and the axis of the nozzle exit 11 can range from about 5° to about 90°.

If the nozzle 10 is coupled to the bit by brazing, the nozzle 10 can be oriented on a bit to direct a flow stream 23 along a particular path for enhanced cleaning of a cutting element 20. The fluid can comprise any number of fluids including water, brine, as well as drilling fluid and any other fluid used in a downhole environment.

The channel 16 should communicate with the passage 14 to ensure contact with a flow stream in the passage 14 to thereby alter the flow stream 23 shape. While the cutting element 20 shown substantially resembles that of a PDC cutting element, similarly the cutting element could also be that used on a diamond impregnated bit as well as a roller cone bit and the other downhole tools previously mentioned. Also optionally, the nozzle 10 may include a single channel, notch or cavity, or more than two. Additionally, nozzle embodiments exist having only one or more channels, one or more notches, one or more cavities, or combinations thereof.

Figure 2:
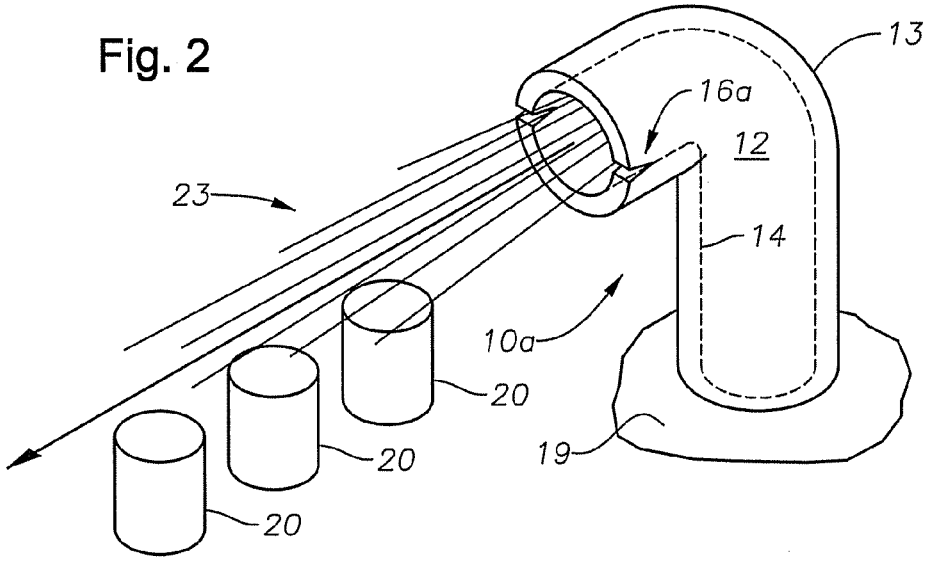
FIG. 2 illustrates in perspective side view an alternative embodiment of the nozzle of claim 1.

With reference now to FIG. 2, an additional nozzle 10*a* embodiment exists where a "V" shaped channel 16*a* is formed in the body 12 at the face 18. In the embodiment of FIG. 2, the nozzle 10*a* is directed at a row 27 of individual cutting elements 20 and discharges a shaped flow stream 23 that remains coherent along the row 27 to clean and cool each cutter 20 in the row 27. Optionally, the nozzle 10*a* can have an oval cross section.

The shape of the particular notch, channel or cavity is not limited to the shapes illustrated herein, but can also include other shapes; a non-exhaustive list includes a half elliptical shape where either the major or minor axis may be pointed towards the lower most end of the channel. Similarly a semi circular configuration may be used to form the channel or notch in the face of these nozzles.

Figure 3:
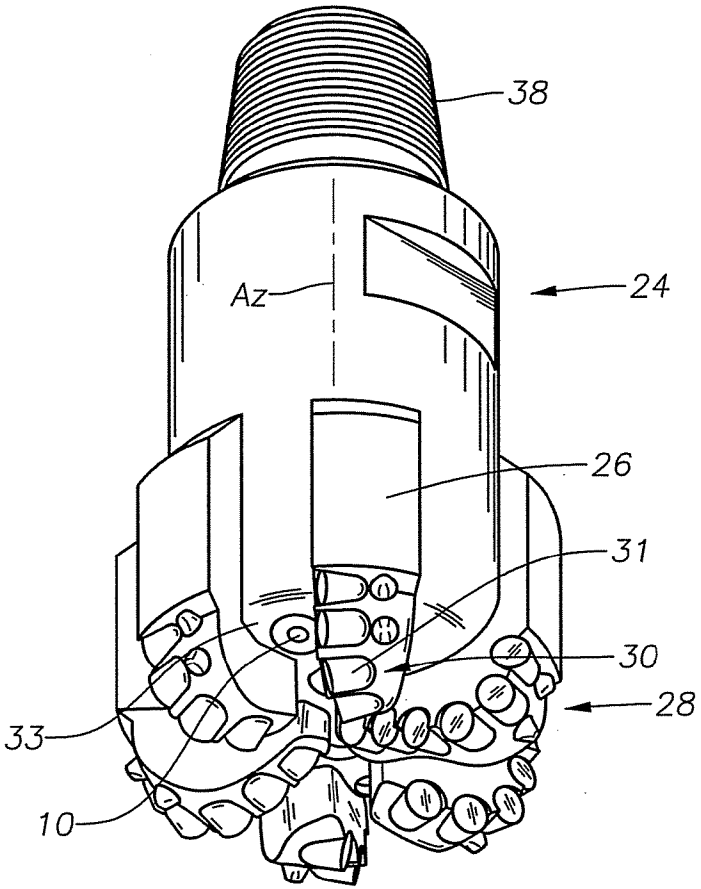
FIG. 3 shows in a side perspective view a drag bit having an embodiment of a nozzle of the present disclosure.

With reference now to FIG. 3, a perspective view of a drag bit 24 is shown. In this view, the drag bit 24 comprises blades 26 extending up from the bit face 28. As known in the art, the blades 26 are raked at an angle depending on their particular cutting application. On each of the blades are rows 30 that comprise cutting elements 31. A nozzle 10 is shown proximate to one of the cutting element rows 30. In this embodiment, the nozzle 10 is directed between the blade 26 having the rows 30 and a preceding blade 33. The spray pattern 23 produced from the nozzle 10 can be shaped by the added channels 16 to create an asymmetric flow pattern. In the example of FIG. 3, the flow pattern height is parallel with the bit axis $A_X$ and its width is perpendicular to the bit axis $A_X$. Thus shaping the fluid flow exiting the nozzle 10 to have a height greater than a standard conical flow path enables more contact with the cutting elements 31 on the row 30. Moreover, the thinner width, as compared to a standard conical flow path, does not contact the trailing side of the preceding blade 33 during use thereby avoiding the possibility of eroding the bit from the cleaning fluid. Also included with this bit 24 is a threaded section 38 for attachment to a drilling system (not shown).

Figure 4:
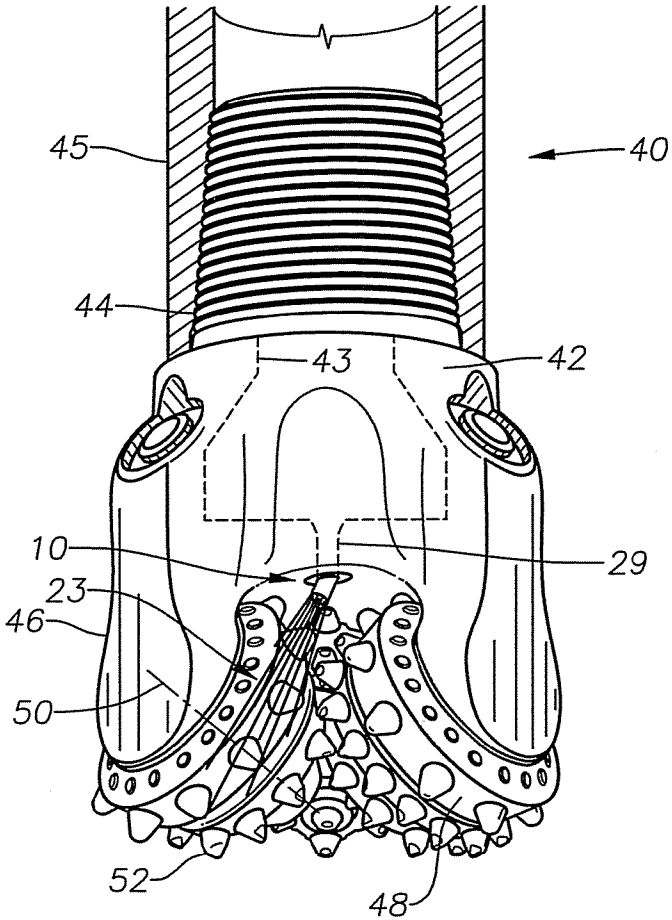
FIG. 4 shows a side view of a roller cone bit having an embodiment of a nozzle of the present disclosure.

FIG. 4 shows a side view of a bit 40 having a body and a threaded portion 44 connected to a drill string 45. Extending downward away from the threaded section on the body 42 are legs 46. The legs 46 may include cones 48 that rotate along their axis with respect to the legs 46. An axis 50 is shown that may illustrate the rotational center of a cone. A series of cutting elements 52 are shown on the cones. In this particular embodiment, a nozzle 10 is shown disposed on a leg 46. A flow feed line 29, shown in a dashed outline, provides fluid communication between the nozzle 10 and a cavity 43 in the bit body 42. Pressurized drilling fluid provided through the drill string 45 flows through the cavity 43, is distributed through the feed line 29 and to the nozzle 10.

In FIG. 4, the nozzle 10 creates a shaped spray pattern 23. Unlike a conical spray pattern 60, the shaped spray pattern 23 can be oriented so its wider length can be aimed to cover more cutting elements 52. Additionally, the shaped spray pattern 23 can avoid some areas prone to erosion as discussed above.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

The invention claimed is:

1. An earth boring bit comprising:

a body;

a cutting surface;

a cutting element on the cutting surface; and a nozzle comprising a body, a bore formed though the body, the bore having an inlet in fluid communication with a fluid source, an outlet directed towards the cutting element, and a flow pattern altering notch provided in the body sidewall proximate the bore outer periphery.

2. The earth boring bit of claim 1, further comprising a face on the nozzle defined by the nozzle outlet outer periphery, wherein the notch is provided on a portion of the face.

3. The earth boring bit of claim 1, wherein the notch spans from the nozzle bore outer periphery to the nozzle body outer surface.

4. The earth boring bit of claim 1, further comprising an additional notch.

5. The earth boring bit of claim 1, wherein fluid flowing from the nozzle forms an elongated non-conical spray pattern.

6. The earth boring bit of claim 1, wherein fluid flowing from the nozzle forms an elongated elliptical pattern.

7. The earth boring bit of claim 6, further comprising a row of cutting elements on the cutting surface and wherein the elongated spray pattern is contactable with each cutting element in the row of cutting elements.

8. The earth boring bit of claim 1, wherein the nozzle bore is non-circular.

9. The earth boring bit of claim 1, wherein the bit is selected from the list consisting of a PDC bit, a roller cone bit, and a reamer bit.

10. A earth boring bit comprising:

a body;

raised blades on the body forming a cutting surface thereon;

polycrystalline diamond cutting elements on the cutting surface; and a nozzle on the body, the nozzle having a bore with an inlet in fluid communication with a fluid source, a face with an outlet directed towards at least one of the cutting elements, and a notch formed in the face on opposite sides of the face, the notch extending from the bore to an exterior of the nozzle through a sidewall of the nozzle.

11. The earth boring bit of claim 10, further comprising a cavity comprising a hole extending through the nozzle body.

12. The earth boring bit of claim 10, wherein the elongated spray contacts a row of cutters.

13. An earth boring bit comprising:

a body;

a leg depending from the body;

a bearing shaft extending radially inward from the leg;

a cutting element mounted on the bearing shaft, the cutter having a row of teeth; and a nozzle on the body, the nozzle having a passage therethough with an inlet in fluid communication with a fluid source, and a face surrounding an outlet directed at the cutting element having a void formed across the face.

14. The earth boring bit of claim 13, further comprising a fluid stream flowing from the nozzle outlet, the stream shaped into an elongated pattern by the void.

15. The earth boring bit of claim 13, the void formed through the nozzle wall.

16. The earth boring bit of claim 13, the void provided at the nozzle outlet.

* * * * *

UNITED STATES PATENT AND TRADEMARK OFFICE

CERTIFICATE OF CORRECTION

PATENT NO. : 7,770,671 B2
APPLICATION NO. : 12/245632
DATED : August 10, 2010
INVENTOR(S) : Suresh G. Patel It is certified that error appears in the above-identified patent and that said Letters Patent is hereby corrected as shown below:

Column 1, line 44, insert --and-- after "debris"
Column 1, line 66, delete "," after "requirements" and insert a --.-- and delete "should" and insert --Should--
Column 2, line 45, delete "examples" and insert --example--
Column 6, line 46, insert --wherein-- before "the void" and insert --is-- before "formed"
Column 6, line 48, insert --wherein-- before "the void" and insert --is-- before "provided"

Signed and Sealed this

Twenty-third Day of November, 2010

David J. Kappos

David J. Kappos
*Director of the United States Patent and Trademark Office*